United States Patent [19]

LeCouturer

[11] Patent Number: 4,999,889

[45] Date of Patent: Mar. 19, 1991

[54] SHOE LACE ARRANGEMENT WITH FASTENER

[76] Inventor: Jacques M. LeCouturer, 350 Holly Dr., San Rafael, Calif.

[21] Appl. No.: 393,555

[22] Filed: Aug. 11, 1989

[51] Int. Cl.[5] ..... A43C 9/00

[52] U.S. Cl. ..... 24/713.2; 24/714.6

[58] Field of Search ..... 24/713.2, 713, 713.3, 24/713.4, 713.5, 713.6, 714, 714.6, 714.9, 68 SK; 36/50

[56] References Cited

U.S. PATENT DOCUMENTS

| | | | |
|---|---|---|---|
| 178,092 | 5/1876 | Vitt | 24/714.6 |
| 386,047 | 7/1888 | Wiley | 36/50 |
| 440,806 | 11/1890 | Griffen | 24/712.4 |
| 669,337 | 3/1901 | Braun | 24/713.3 |
| 2,266,083 | 12/1941 | Rzepa | 24/712.4 |
| 2,861,310 | 11/1958 | Martin | 24/68 SK |
| 3,491,465 | 1/1970 | Martin | 36/50 |
| 3,683,520 | 8/1972 | Partagas | 36/50 |
| 4,051,611 | 10/1977 | Chalmers | 24/68 SK |
| 4,253,217 | 3/1981 | Marzocchi | 24/69 SK |
| 4,310,951 | 1/1982 | Riedel | 24/68 SK |
| 4,470,206 | 9/1984 | Annovi | 24/68 SK |

*Primary Examiner*—Victor N. Sakran

[57] ABSTRACT

A shoe lace arrangement with fastener where a lace (24) is engaged in a hole attachment (22) and becomes engaged on a groove attachment (23) as it crosses over a shoe frontal opening (21). The lace ends are tied permanently leaving enough slack to disengage the lace from the groove. Once the lace is removed from the groove, a lace loop (26) begins in one of the hole attachment and ends in one of the hole attachment on the same side of the shoe frontal opening; thus allowing the un-restricted opening of the shoe. The slack is adjustable by lace placement in a grove (25). Final tension in the shoe lace arrangement is obtained with a tension lever (20).

9 Claims, 3 Drawing Sheets

FIG. 1
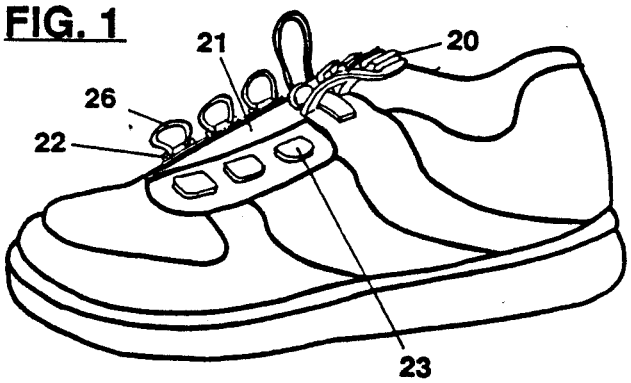
FIG. 2
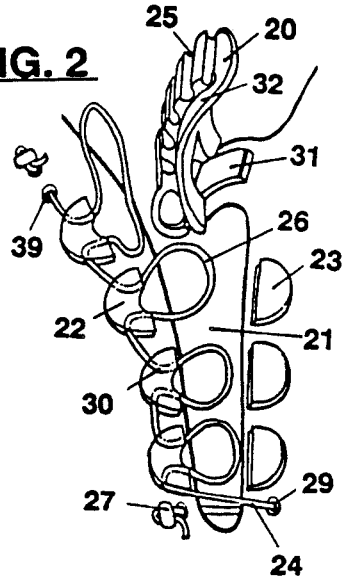
FIG. 1A
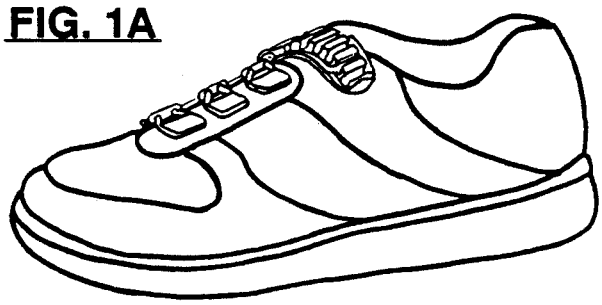
FIG. 2A
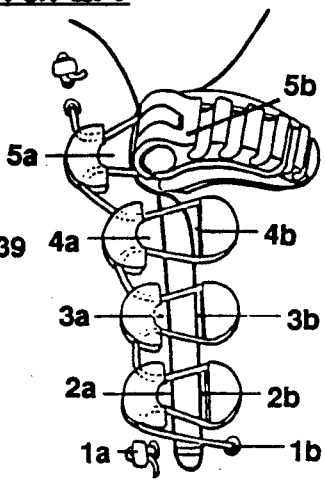
FIG. 3
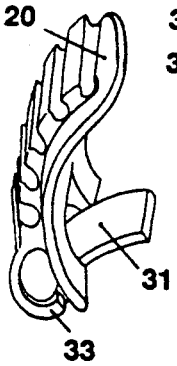
FIG. 3A
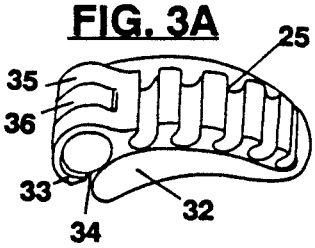
FIG. 4
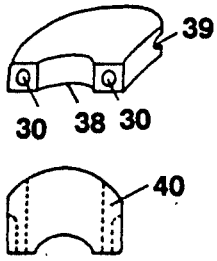
FIG. 4A
FIG. 5
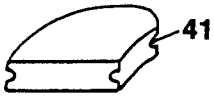
FIG. 7
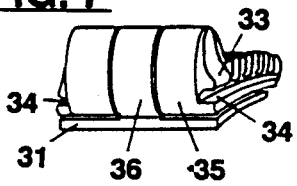
FIG. 9
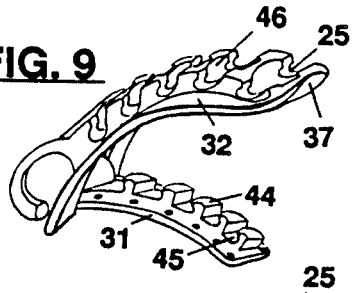
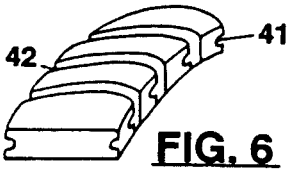
FIG. 6
FIG. 8
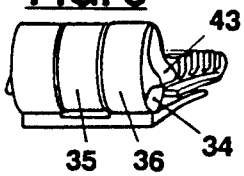
FIG. 9A
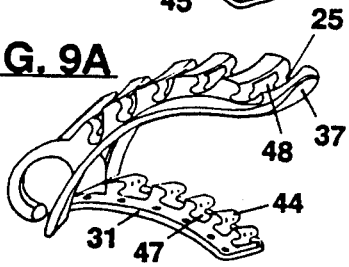

FIG. 15
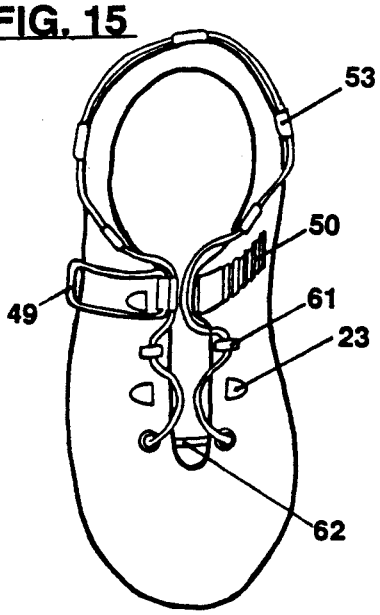
FIG. 15A
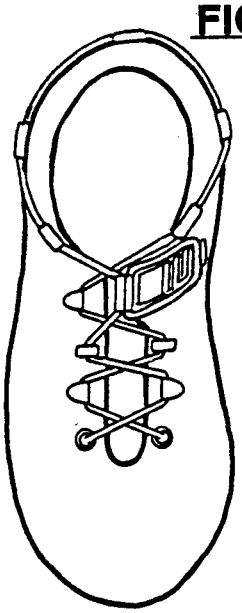
FIG. 16
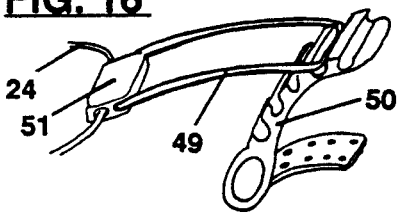
FIG. 16A
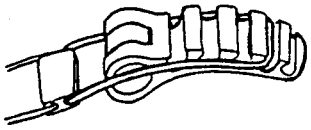
FIG. 17
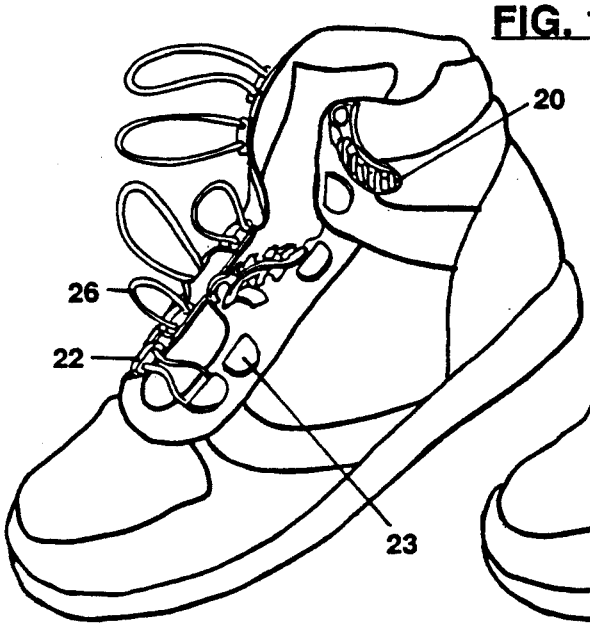
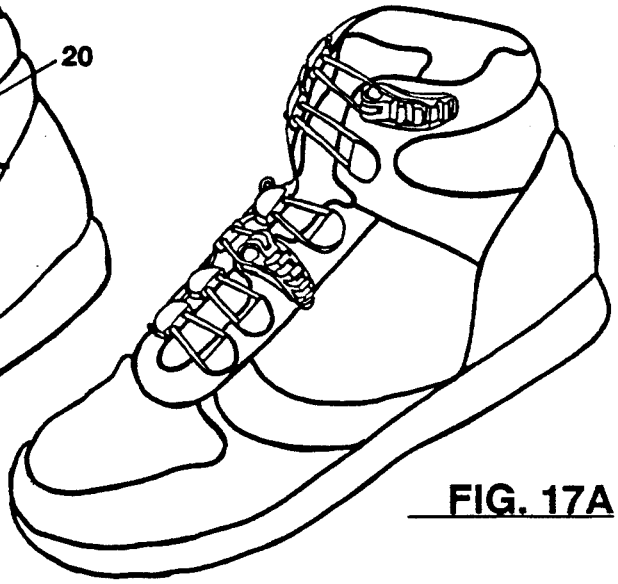
FIG. 17A

SHOE LACE ARRANGEMENT WITH FASTENER

FIELD OF THE INVENTION

This invention relates to a practical shoe lace arrangement to put on and remove shoes with a fastener to tighten the lace.

BACKGROUND OF THE INVENTION: PRIOR ART.

The quest for a fast, convenient, secure and reliable method to tie and un-tie shoe laces goes back too far to be asserted. The main nuisances with present lace attachments are in dealing with:

multiple bowknots and the length of the lace,
knots slipping, becoming un-tied, difficult to un-tie.
opening the shoe wide enough to put it on and removing it,
frayed laces, dirty laces, broken laces.

With the present art the lace has to be soft and pliable so the users can tie a durable knot. Cotton is the material of choice to this end but cotton also frays, becomes dirty and breaks under wear.

OBJECTS AND ADVANTAGES OF THE INVENTION

While putting on and removing a pair of sports shoes today is easier than dealing with ski shoe laces when the first tension fasteners were introduced 30 years ago, today the buying public expect more convenience from their products.

The popularity of the "moccasin" type of shoes for daily wear is proof, if one was needed, of the public reluctance to deal with shoe laces. It is also apparent that the line between sports shoes bought and worn for all sorts of leisure activities and shoes worn for going to an office, to Church, to visit friends; is less and less distinct.

The object of the invention is to improve the concept of the tension fastener to fit the needs of most sports shoes on the assumption that if an improvement can tighten the shoe with few quick motions and offer comfort and security; it will make the shoe preferred in the market place.

A case in point is the acceptance of VELCRO (Trade Mark) to provide a quick attachment, although it is doubtful that it delivers the kind of closure tension needed for most sports.

The time to secure sports shoes with the proposed lace attachment is estimated at 5 to 10 seconds versus 30 to 60 seconds to secure the shoes with conventional laces. The time to untie the attachment for removing the shoe is estimated at 3 to 5 seconds, versus 15 seconds to several minutes for conventional laces.

Conventional shoe lacing calls for using two hands and a support to hold the foot high enough to tie the knots comfortably. The invention eliminates these limitations.

Based on the review of hundreds of patents, past inventors have only attempted to solve one or two of the many problems presented by this invention. To arrive at a compelling solution, the invention solves these problems with interdependent improvements, an approach that had not been found before.

The advantages of the present invention are as follows:

1. The improvement permits the convenient, quick, un-restricted opening of the shoe.
2. The improvement eliminates bowknot, and the shoe can be opened and closed tight with two fingers.
3. The tension in the attachment is distributed on the entire lace. No pressure point is anticipated.
4. Attachments do not protrude significantly and are unlikely to cause injury.
5. Locking features insure that the attachment does not come loose during exercise.
6. The breadth of the attachment can accommodate any foot sizes and heights of in-steps.
7. The improvement is discreet and esthetically pleasing. It does not significantly modify the appearance of the product it improves.
8. The invention permits the use of a stronger lace that will give the shoe a clean and neat appearance.
9. The improvement is not expected to change manufacturing costs significantly.

DESCRIPTION REFERENCES AND NUMERALS

The locations of the lace attachments are numbered by pairs from pair 1 to pair 5 starting from the toes. On one side of the shoe frontal opening, the attachments are numbered 1*a*, 2*a*, 3*a*, 4*a*, 5*a* and so forth, and 1*b*, 2*b*, 3*b*, 4*b*, 5*b* and so forth, on the other side. See example in FIG. 2A.

| | |
|---|---|
| 20. Lever with groove, ridge. | 21. Shoe frontal opening |
| 22. Two holes protrusion | 23. Protrusion peripheral groove |
| 24. Lace | 25. Groove on lever |
| 26. Loop in lace | 27. Stopper for lace end |
| 28. Crossing loop | 29. Single hole attachment |
| 30. Pair of holes | 31. Plate's supporting hinge |
| 32. Ridge on lever | 33. Rotating bulge on hinge |
| 34. Gap underneath bulge | 35. Hinge's movable part |
| 36. Hinge's stationery part | 37. Raised end of lever |
| 38. Recess to grab lace | 39. Lace exit notch |
| 40. Phantom lace path | 41. Peripheral groove |
| 42. Transversal surface groove | 43. Stationary bulge on hinge |
| 44. Lace locking stud | 45. Under-cut facing hinge |
| 46. Groove recess for stud | 47. Under-cut facing lever end |
| 48. Groove's cavity for stud | 49. Annulus |
| 50. Lever, grooves, no ridge | 51. Member holding annulus |
| 52. Overlapping loop | 53. Lace holder |
| 54. Slack attachment | 55. Knot to regulate slack |
| 56. Twin hole on lever | 57. Lever with hole and ridge |
| 58. Aperture for stud | 59. Locking ring for lever |
| 60. Locking ring support | 61. Protrusion with one hole |
| 62. Endless loop | 63. Half-ring hole attachment |

DESCRIPTION OF THE DRAWINGS

Meaning of the words used:

ANNULUS describes a rigid elongated ring attached to the lace to be engaged in a groove or a hole to perform a shoe closure.

FASTENER indicates a tightening device. In the invention, the fastener has a hinged tension lever with either a hole or grooves to reduce the slack. The fastener establishes the tension in the lace when pulling on its lever.

GROOVE ATTACHMENT refers to a situation where the lace can be removed from this attachment with the two ends of the lace immobilized. The groove can be mounted on a protrusion installed on the shoe upper or on a tension lever.

HOLE ATTACHMENT refers to a situation where the lace can only be drawn out of the attachment after liberating the end of the lace. The hole can be through the shoe upper as an eyelet, or be a half ring on the edge of the frontal opening, or a hole in a protrusion, or a hole on a tension lever.

In the present invention, the lace is not drawn out of a hole attachment in order to put on or take out the shoe.

LIST OF DRAWINGS

FIG. 1 and 1A. Lace arrangement and fastener for a low cut shoe in open position and closed position.

FIG. 2 and 2A. Detail of the lace arrangement with protrusions having two holes and protrusions with peripheral groove.

FIG. 3 and 3A. Detail of a fastener with tension lever having grooves and a ridge.

FIG. 4. Detail of protrusion with two holes.

FIG. 4A. Protrusion with two holes showing lace phantom path.

FIG. 5. Protrusion with peripheral groove.

FIG. 6. Protrusion with multiple surface grooves.

FIG. 7. Front view of the fastener's hinge illustrating a rotating bulge and lace catching gap.

FIG. 8. Front view of the fastener's hinge illustrating a stationary bulge and lace catching gap.

FIG. 9. Lever with grooves and lace catching stud having a cut-out facing the hinge.

FIG. 9A. Lever with groove and lace catching stud having a cut-out facing the end of the lever.

Figure 10:
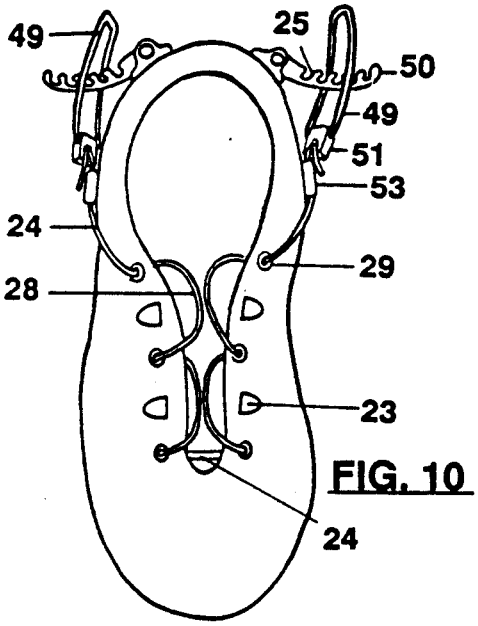
Figure 10A:
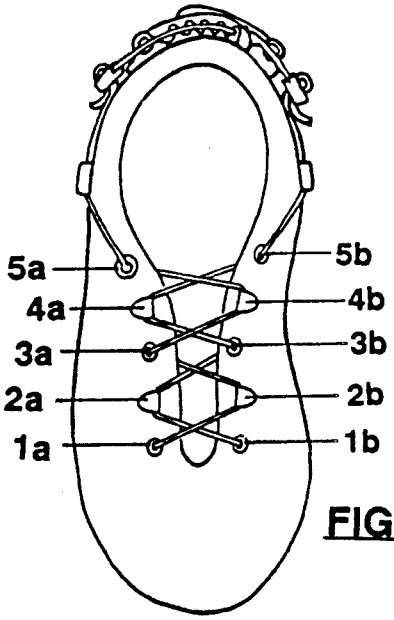

FIG. 10 and 10A. Embodiment of the invention with annulus and tension lever having no ridge.

Figure 11:
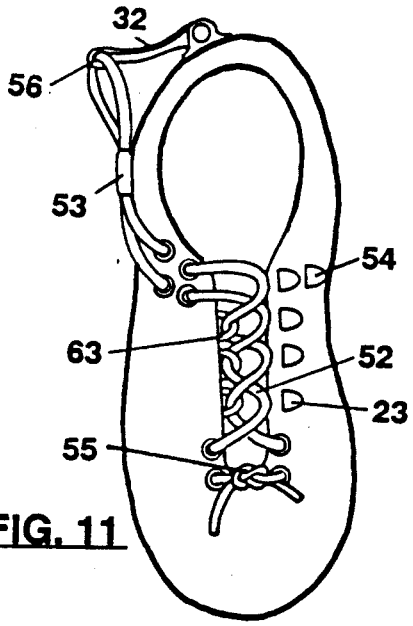
Figure 11A:
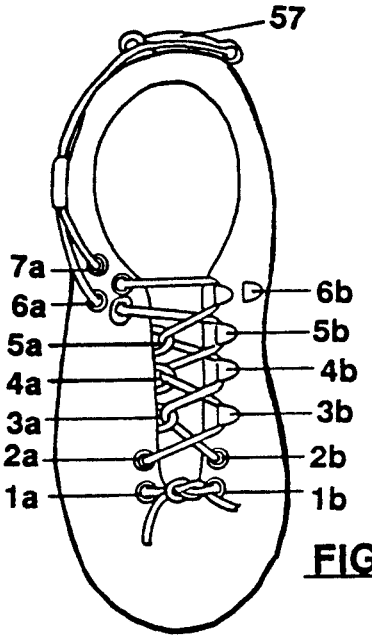

FIG. 11 and 11A. Embodiment of the invention with a hole mounted on the tension lever and the lace passing through this hole.

Figure 12:
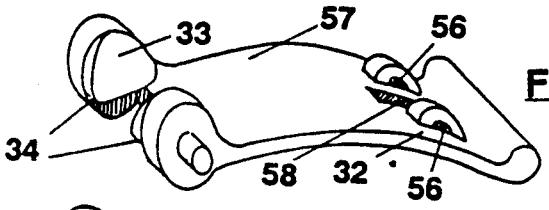

FIG. 12. Rotatable tension lever with hole for lace and embrasure for lace catching stud. The rotating bulge and lace catching gap are in the center of the hinge.

Figure 13:
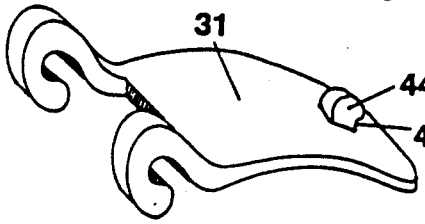

FIG. 13. Stationery plate and hinge support with stud. center of the hinge.

Figure 14:
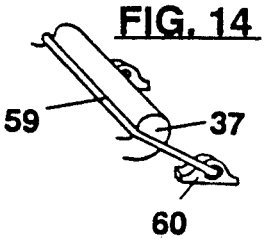

FIG. 14. Safety ring to hold tension lever.

FIG. 15 and 15A. Embodiment of the invention with floating annulus.

FIG. 16 and 16A. Engagement of the annulus on the tension lever with grooves having no ridge.

FIG. 17 and 17A. Lace arrangement for high-cut shoe. This embodiment shows the lace in two circuits and two tension lever with ridge.

DESCRIPTION OF THE INVENTION

The invention is an arrangement of holes and grooves lace attachments that can be combined in over a hundred possible ways. A lace 24 goes through a hole attachment 22 and goes by a groove attachment 23 one or more times. When the lace crosses over a frontal shoe opening 21 for the purpose of closing the shoe, the lace goes from the hole attachment to the groove attachment or vice versa as the case may be.

The two ends of the lace are found secured prior to wearing the shoes and can be either:

(a) tied together as a one time operation or,
(b) one end tied to the shoe upper and the other end attached to an annulus 49 or,
(c) both ends tied to the shoe upper or,
(d) an endless loop 62 or,
(e) tied by the wearer.

In all embodiments, two devices are added to the lace circuit:

1. One device is a slack reducing means which can be either:

(a) A slack reducing attachment 54 placed further apart from the edge of the shoe frontal opening.
(b) A protrusion with transversal horizontal grooves 42 on its surface.
(c) A plurality of grooves on the tension lever.

2. The second device is a hinged fastener of the type shown in FIG. 3 and 3A with a tension lever 20 and a groove 25 or of the type shown in FIG. 12 with a hole 56 to engage the lace. But many other types of tension lever are possible.

DESCRIPTION OF THE INVENTION TYPICAL EMBODIMENTS

A typical embodiment is illustrated in FIG. 1, with the shoe open, and FIG. 1A with the shoe closed. On one side of shoe frontal opening 21 are protrusions with peripheral groove 23, and tension lever 20. On the opposite side of the shoe are the protrusions with holes 22. The lace arrangement with the shoe open and closed is detailed in FIG. 2 and 2A. In these 2 drawings, each end of the lace is secured to the shoe upper with a stopper 27 blocking the lace from entering a single hole attachment 29.

The lace arrangement in FIG. 1 & 1A utilizes protrusions with two holes FIG. 4. This auxiliary improvement pre-disposes the formation of a loop 26 to be wrapped around opposite protrusion with groove 23. For closing the shoe FIG. 2A, the lace is held by groove 25 of lever 20, FIG. 3 & 3A. Once lever 20 is closed, the tighten lace banks against a ridge 32 and, if elected in the construction of the fastener, is maintained against ridge 32 by passing in a gap 34 under a bulge 33.

Another embodiment is shown in FIG. 10 and 10A where holes and grooves attachments now alternate in pairs. This time, a loop 28 crosses an opposite one as the lace leaves the hole to go to the groove. One end of the lace is attached by a connecting member 51 to an annulus 49. The permanent slack in the lace can be adjusted where the lace is tied to member 51. A tension lever 50 has grooves facing the shoe upon its closing. In this embodiment the tension lever does not need a ridge to hold the tension because of the annulus.

In embodiment shown in FIG. 11 and 11A, the hole attachment is a half ring 63 and the lace is tied by a knot 55 to establish a permanent slack. The overlapping loops are between two hole attachments on the same side of the shoe frontal opening. A lace holder 53 maintains the lace as it goes to the back of the shoe.

Endless loop arrangement 62 is shown in FIG. 15 and 15A. A single hole protrusion 61 above the shoe upper has hole parallel with the edge of the shoe upper.

In embodiment shown in FIG. 17 and 17A, the lace is separated in two circuits with two fasteners. This arrangement for high cut shoes permits a different tension level around the ankle.

DESCRIPTION OF THE INVENTION MAIN ELEMENTS

TENSION FASTENER WITH RIDGE. FIG. 3 AND 3A

In many embodiments the lace is engaged directly in one of the grooves of the tension lever. To prevent the lace under tension from pushing against the foot and unsnapping the fastener the lace banks against ridge 32. Ridge 32 extends along grooves 25 on both side of lever 20. This ridge is a substitute for the rigidity of the metallic annulus.

PROTRUSION WITH TWO HOLES. FIG. 4 and 4A.

The user's only motions for closing the shoe with the present invention are to grasp the lace as it leaves the hole attachment and position the lace in the grooves. To make this task easier, the hole attachment is designed to constrain the lace into making a loop by coming in and out of a pair of holes 30 above the shoe upper. The protrusion has a recess 38 making it easy to grasp the lace for positioning around the groove. A lace phantom path 40 inside two holes protrusion 22 is shown on FIG. 4A. Exit of lace by a notch 39 can be used to hold the end of the lace.

PROTRUSION WITH PERIPHERAL GROVE. FIG. 5.

The typical shoe hook is improved in this invention to prevent anything from being caught accidentally and causing injury. In FIG. 5, the lace is held by a shallow peripheral groove 41 with just enough width and depth for the lace.

PROTRUSION WITH MULTIPLE TRANSVERSAL SURFACE GROVES. FIG. 6

Whenever a tension lever with a hole or a twin hole to hold the lace is used, there is a need for a device to regulate the slack in the lace. One of transversal surface groove 42 is used to regulate the slack and change tension in the lace circuit.

TENSION LEVER WITH LACE CATCHER. FIG. 7 AND 8

FIG. 7 is a front view of a rotating lace catcher. Gap 34 under rotating bulge 33 extends at a end of hinge movable part 35. When the lever with the lace engaged in the groove is rotated, the bulge rotates with it and the lace is caught in gap 34 when the fastener closes. With the catcher, the lace is maintained below the hinge's fulcrum and adds security against the lever snapping open under foot pressure.

In FIG. 8, a stationary bulge 43 extends at a end of the hinge's stationary part 36. Here, the bulge does not rotate with the lever. When the lever rotates toward its close position, the elasticity in the lace causes it to pass over the bulge and take position in gap 34.

HINGED TENSION LEVER WITH LOCKING MEANS FIG. 9 AND 9A

One concern with the tension lever is to have it unsnap under strenuous foot activities such as tennis. Several types of locking means can be added to the fastener to prevent the tension lever from opening under tension.

FIG. 9 shows a plate 31 supporting lever's hinge, extending to the length of the lever. On the plate is a number of nearly vertical studs 44, one stud for each corresponding groove on the lever. At the base of each stud is an under-cut 45 facing the hinge that catches the lace once the lever is closed. In the center of each groove 25 is a curved recess 46 perpendicular to the plane of the lever. Upon closure of the lever, stud 44 enters into recess 46 of the corresponding groove. The lace is caught by under-cut 45 of the stud.

FIG. 9A shows a variation of the preceding locking means. An under-cut 47 in stud 44 faces the end of the lever. In the center of each groove is a cavity 48 on the vertical wall of the groove. When the lever is closed, stud 44 takes position inside cavity 48. The lace is then caught by under-cut 47.

FIG. 14 shows an alternate lever lock being a ring 59 attached to a support 60 on the shoe upper. The ring can be tilted to catch and hold down a raised end of lever 37.

TENSION LEVER WITH HOLE FIG. 12 AND 13.

In this version of the tension lever, a twin hole 56 is mounted on a lever 57 and the lace is circuited in the twin holes where it slides freely. The lace goes in the center of the hinge where it passes over rotating bulge 33 to be caught in gap 34. Stud 44 on plate 31 enters into an aperture 58 upon closing of lever 57 and under-cut 47 catches the lace and holds the lever closed.

Under tension, the lace banks against ridge 32. Lace tensioning with the lever is regulated by a slack reducing attachment 54 as in FIG. 11.

TENSION LEVER WITH GROOVES AND FLOATING ANNULUS FIG. 16 AND 16A.

Annulus 49 transfers the line of pull by the lace on lever 50, below the lever's hinge fulcrum. It prevents lace tension to:

(a) overcome the hinge's dead center and (b) push the lever away causing the fastener to open. Connecting member 51 holds the floating annulus and the lace. The lace slides inside member 51 and the lace pressure is distributed on the entire lace.

SLACK IN THE LACE TO OPERATE THE TENSION LEVER.

The slack necessary and sufficient to install the lace in the grooves should be less than 2 inches. Beyond this, the slack is reduced by other means than the tension lever.

Changing the slack in the lace can be done with a protrusion having multiple grooves as shown in FIG. 6; or slack reducing protrusion with groove 54 installed further away from the edge of shoe frontal opening as in FIG. 11.

STOPPER FOR THE END LACE

In many embodiments, the lace is secured to the shoe upper. One preferred way to immobilize the end of the lace is to have the lace going in and out of small member 27 that itself cannot go through hole 29 as shown in FIG. 2. Having the lace traversing the hole in member 27, and after having made a sharp bend come back into the same hole, is sufficient from preventing the lace from slipping inside the hole.

Notch 39 of protrusion shown in FIG. 4 can be used in the same manner to hold the end to the lace and so can a hole in connecting member 51 shown in FIG. 10.

NATURE OF THE LACE

The common shoelace requirements of flexibility with gripping properties to hold the knots is out of order.

The preferred lace for most of the proposed embodiments has a slippery surface to slide easily in the holes and around the grooves. The sliding improves distribution of tension on the entire lace.

The lace can now be made: (1) more resistant, (2) more durable, (3) less pliable and subject to fraying (4) less soft and subject to becoming dirty than the common shoe lace; by using more synthetic material in the lace composition.

A lace less flaccid than ordinary shoe lace will maintain its general position and be easier to position around the grooves and disengaged from same.

SHOE TONGUE

The usual requirements for the tongue are linked to the space between the edges of the frontal openings. In conventional shoes, this space serves several functions:

(a) To provide closure leeway for different in step heights, (b) To install the lace in cross patterns, (c) To cushion the foot against lace pressure, pressure which increases with the width of the frontal opening.

Without holes into the shoe upper, as it is possible with many embodiments of the invention, the tongue can be sewn to one side of the shoe frontal opening. This would resolve the problem of tongue migration under strong foot motions.

OPERATING THE INVENTION

EMBODIMENT WHERE THE LACE DOES NOT CROSS ITS OWN PATH

At rest, the opening of the shoe is completely unrestricted as shown in FIG. 1 and 2. Once the foot is in place the shoe frontal opening is closed FIG. 1A and 2A. On one side of the shoe frontal opening are holes 22 and on the other side of the opening are grooves 23.

FIG. 2A shows the ends of the lace secured in attachments 1*a* and 6*a* to set the slack in the lace. Once the slack is set for the wearer there is no need to change it again. The lace goes in and out of protrusion with two holes in lace attachments 2*a*, 3*a*, 4*a* and 5*a*. Each time, the lace makes loop 26.

Once the foot is in place, the shoe is closed; FIG. 1A and 2A. The lace is wrapped, possibly with one hand, around protrusions with groove 23 in attachments 2*b*, 3*b*, and 4*b*. Loop 26 is wide enough for the finger to grab inside it and carry it around groove 23. When pulling loop around 3*b*, the preceding loop is already in place around 2*b*.

The need for slack in the lace remains nearly constant and is sufficient to go around each peripheral groove, one at a time. When the lace is engaged on all the grooves of the protrusions the last loop is engaged in one of the groove of the tension lever.

The tension lever in FIG. 3 stands in an open position. Upon closing the lever in FIG. 3A the lace slides down against bulge 33 to take position in gap 34.

EMBODIMENT WHERE HOLES AND GROOVES ALTERNATE IN PAIRS

FIG. 10 and 10A. In this embodiment, holes 29 and grooves 23 alternate in pairs. Crossing loops 28 are disengaged from grooves 23 to open the shoe. Each end of the lace is tied to annulus 49 by connecting member 51. Member 51 is also used to regulate the slack in the lace. In this version of the tension lever, the grooves face the shoe upon closure.

Starting from the middle of the lace between eyelets 1*a* and 1*b*, the even attachments are grooves and the odd attachments are holes. One half of the lace goes from 1*a* to 2*b* to 3*a* to 4*b* to 5*a* and to the annulus. The second half of the lace goes from 1*b* to 2*a*, 3*b*, 4*a*, to 5*b* and to the annulus.

EMBODIMENT WHERE GROOVES ARE ON ONE SIDE OF THE SHOE OPENING.

FIG. 11 and 11A. In this embodiment grooves 23 are on one side of the shoe opening and holes 63 on the other side. This disposition allows for the use of the common shoe lace.

In 1*b*, 1*a*, 2*a*, 2*b*, 3*a*, 4*a*, 5*a*, 6*a*, 7*a* are holes and in 3*b*, 4*b*, 5*b*, 6*b* are grooves. Tension lever 57 with hole 56 and ridge 32 as shown in FIG. 12 and 13 is at the heel. The lace goes around part of the ankle increasing the security of the attachment to the foot. The lace makes an overlapping loop 52 as it crosses its path going up and down the shoe frontal opening.

Permanent knot 55 between 1*a* and 1*b* is pre set to the proper slack for the desired tension. Afterwards, the lace is placed around the grooves and one snap of the tension lever establishes the final tension. To remove the shoe, the tension lever is opened releasing slack in the lace. The lace is then disengaged from the grooves while held in its general position by the holes.

An alternative to having the wearer knot the ends of the lace between 1*a* and 1*b* is the looped lace. Slack in the looped lace can be manipulated with secondary groove attachment 54 or with attachments having multiple grooves as shown in FIG. 6.

EMBODIMENT WITH FLOATING ANNULUS

FIG. 15 and 15A. This embodiment is possible with the two previous arrangements. The two ends of the lace are either tied together or secured to the shoe upper. The hole attachments shown here are protrusions above the shoe upper with one hole 61. Lace holders 53 holds the lace around the ankle. The lace makes endless loop 62. The floating annulus channels the tension created by the lever on the entire lace.

OTHER VARIATIONS IN THE EMBODIMENT

Many variations of the preceding embodiments are possible. The specifications are the same:

1. The two ends of the lace are secured as follows:
   (a) tied together permanently with the proper slack.
   (b) One end tied to the shoe upper and the other end tied to a member holding an annulus.
   (c) Each tied to a member itself holding an annulus.
   (d) Both ends secured to the shoe upper.
   (e) Both ends tied at the factory or an endless loop.
2. The lace is engaged alternatively into the hole attachment and on the groove attachment and when the lace crosses over the shoe frontal opening, the lace goes from the groove to the hole or vice versa as the case may be.
3. The tension in the lace is established by a fastener.

SUMMARY, RAMIFICATIONS AND SCOPE

Accordingly, the reader will see that the lace arrangement with fastener of this invention can be used effectively to replace the ordinary lace for all kinds of shoes.

The inserting of the foot in the shoe and its removal have been made simple. The opening and closing of the shoe that are separate and distinct operations have also been made simple.

Comfort, adaptability, versatility, safety, reliability and durability are qualities apparently inherent with the invention. These qualities generally have an enormous market appeal.

The appearance of the shoe is bound to be enhanced by these improvements.

Although the preceding description contains many specificities, these should not be construed as limiting the scope of the invention but are only intended to show the versatility of the invention and the many ways the described elements can be fabricated and combined in hundreds of ways to satisfy different requirements.

For example, a shoe for soccer may require a continuous strip of material for the holes and grooves attachment, on each edge of the shoe frontal opening, with no space between each attachment. The tension lever in the back of the shoe may have to be encased in plastic rubber.

The descriptions only disclose some of the possibilities of the invention but the scope of the invention is to be determined by the claims and their legal equivalents rather than by the examples given.

I claim:

1. A lace arrangement with a fastener comprising a hinged tension lever supporting a lace attachment means, wherein said lace goes from hole to groove and from groove to hole as the case may be across the shoe frontal opening, and further comprising:

(a) a bulge laterally protruding on a side of the axis of said hinge of said tension lever, (b) a lace catcher gap located underneath said bulge creating a void between said bulge and the shoe upper when said lever is closed, whereby said lace arrangement, once secured on said attachment means and tighten by rotation of said lever, is engaged in said gap.

2. A lace arrangement with fastener of claim 1 wherein said bulge with said gap is integral with the rotating part of said hinge of said tension lever.

3. A lace arrangement with fastener of claim 1 wherein said bulge with said gap is integral with the stationary part of said hinge of said tension lever.

4. A lace arrangement with fastener of claim 1 wherein said bulge with said gap is integral with the pin of said hinge of said tension lever.

5. The lace arrangement with fastener of claim 1 wherein said tension lever includes a ridge extending laterally on a side of said attachment means when said lever is in a closed position, whereby said lace, once tighten by rotation of said tension lever, is caused to bank against said ridge.

6. The lace arrangement with fastener of claim 1 wherein a groove attachment member faces away from the shoe upper when said lever is closed.

7. The lace arrangement with fastener of claim 1 further including a twin holes member attached to and above the surface of the shoe upper and having 2 parallel holes facing the frontal opening edge of the shoe upper.

8. The lace arrangement with fastener of claim 1, further including a rotatable ring, attached on the shoe upper near the extremity of said tension lever when closed, whereby once said lever is tightened, said ring is rotated over the extremity of said lever and maintains said lever in its closed position.

9. A lace arrangement with a fastener wherein said lace goes from hole to groove and from groove to hole as the case may be across the shoe frontal opening and further comprising:

(a) a plate supporting a hinge for a rotatable tension lever with attachment means, said plate affixed to the shoe upper underneath said lever, (b) a stud having a cut-out at its footing standing on said plate, (c) an embrasure transversing said attachment means and said tension lever, whereby upon closure of said lever, said stud takes position into said embrasure and said lace becomes engaged in both said attachment means and said cut-out of said stud.

* * * * *

UNITED STATES PATENT AND TRADEMARK OFFICE

CERTIFICATE OF CORRECTION

PATENT NO. : 4,999,889

DATED : March 19, 1991

INVENTOR(S) : Jacques M. Lecouturier

It is certified that error appears in the above-identified patent and that said Letters Patent is hereby corrected as shown below:

Title page:

Item (19) and (76) inventors, should read-- "Lecouturier"--.

Signed and Sealed this

Eighteenth Day of August, 1992

*Attest:*

DOUGLAS B. COMER

*Attesting Officer*

*Acting Commissioner of Patents and Trademarks*